US010669074B2

(12) United States Patent
Simpson et al.

(10) Patent No.: US 10,669,074 B2
(45) Date of Patent: Jun. 2, 2020

(54) DISPENSER FOR DISPENSING FLOWABLE MATERIAL

(71) Applicant: Beiersdorf AG, Hamburg (DE)

(72) Inventors: Melissa Marie Simpson, Bartlett, TN (US); Rutao Li, Whippany, NJ (US); Jerry V. Foster, III, Valdosta, GA (US); Jose Gamboa, Dunwoody, GA (US); Martin Johnson, Clinton, MA (US); Stephen Joel Zwonitzer, Lawrenceville, GA (US); Eric J. Schmidt, Wheaton, IL (US)

(73) Assignee: BEIERSDORF AG, Hamburg (DE)

( * ) Notice: Subject to any disclaimer, the term of this patent is extended or adjusted under 35 U.S.C. 154(b) by 0 days.

(21) Appl. No.: 16/192,012

(22) Filed: Nov. 15, 2018

(65) Prior Publication Data

US 2019/0084726 A1 Mar. 21, 2019

Related U.S. Application Data

(63) Continuation of application No. 15/101,260, filed as application No. PCT/US2014/068473 on Dec. 4, 2014, now abandoned.

(Continued)

(51) Int. Cl.
*B43M 11/06* (2006.01)
*B65D 35/36* (2006.01)

(Continued)

(52) U.S. Cl.
CPC ..... *B65D 35/36* (2013.01); *B65D 1/32* (2013.01); *B65D 35/02* (2013.01); *B65D 35/28* (2013.01);

(Continued)

(58) Field of Classification Search
CPC ..... B65D 35/36; B65D 35/40; B65D 35/44; B65D 35/46

(Continued)

(56) References Cited

U.S. PATENT DOCUMENTS 4,239,132 A 12/1980 Beall et al.
5,190,190 A 3/1993 Fudalla (Continued)

FOREIGN PATENT DOCUMENTS

CN 1332691 A 1/2002
CN 1787879 A 6/2006

(Continued)

OTHER PUBLICATIONS

"International Search report for corresponding Application No. PCT/US2014/068473 dated Mar. 18, 2015".

(Continued)

*Primary Examiner* — Jennifer C Chiang
(74) *Attorney, Agent, or Firm* — Abel Schillinger, LLP

(57) ABSTRACT

A dispenser for dispensing flowable material. The dispenser comprises a resiliently deformable body encompassing a closed volume with an optional flexible pouch disposed therein to accommodate the flowable material. A discharge element having at least one discharge opening, along with at least one valve regulating flow from the closed volume or the flexible pouch and through the discharge opening is also provided. The body is configured so that a threshold amount of deformation of the body causes the flowable material to urge from the closed body through the discharge opening or the pressure increase of the closed volume acting on the flexible pouch sufficiently so that flowable material accommodated in the flexible pouch is urged therefrom through the discharge opening.

14 Claims, 18 Drawing Sheets

Related U.S. Application Data

(60) Provisional application No. 62/033,324, filed on Aug. 5, 2014, provisional application No. 61/912,590, filed on Dec. 6, 2013.

(51) Int. Cl.

| | |
|---|---|
| ***B65D 35/46*** | (2006.01) |
| ***B65D 35/40*** | (2006.01) |
| ***B65D 77/22*** | (2006.01) |
| ***B65D 1/32*** | (2006.01) |
| ***B65D 83/00*** | (2006.01) |
| ***B65D 47/20*** | (2006.01) |
| ***B65D 47/42*** | (2006.01) |
| ***B65D 51/16*** | (2006.01) |
| ***B65D 51/24*** | (2006.01) |
| ***B65D 35/02*** | (2006.01) |
| ***B65D 35/28*** | (2006.01) |
| ***B65D 35/44*** | (2006.01) |
| ***B65D 35/56*** | (2006.01) |
| *B05B 11/04* | (2006.01) |

(52) U.S. Cl.

CPC ..... *B65D 35/40* (2013.01); *B65D 35/44* (2013.01); *B65D 35/46* (2013.01); *B65D 35/56* (2013.01); *B65D 47/20* (2013.01); *B65D 47/2018* (2013.01); *B65D 47/42* (2013.01); *B65D 51/1611* (2013.01); *B65D 51/1644* (2013.01); *B65D 51/249* (2013.01); *B65D 77/225* (2013.01); *B65D 83/0055* (2013.01); *B05B 11/048* (2013.01); *B65D 2205/00* (2013.01)

(58) Field of Classification Search

USPC ..... 401/183, 262, 263, 265

See application file for complete search history.

(56) References Cited

U.S. PATENT DOCUMENTS

| | | | | |
|---|---|---|---|---|
| 6,332,726 | B2 | 12/2001 | Yamamoto et al. | |
| 6,364,163 | B1 | 4/2002 | Mueller | |
| 6,375,046 | B1 | 4/2002 | Alleard et al. | |
| 6,491,463 | B1 | 12/2002 | Richard | |
| 6,851,803 | B2 | 2/2005 | Wooley et al. | |
| 7,036,690 | B2 | 5/2006 | Tsubaki et al. | |
| 7,828,177 | B2 * | 11/2010 | Decottignies | B05B 11/007 222/321.7 |
| 7,854,352 | B2 | 12/2010 | Davies et al. | |
| 8,117,451 | B2 | 2/2012 | Endoh | |
| 8,777,505 | B2 | 7/2014 | Thorez et al. | |
| 9,364,649 | B2 * | 6/2016 | Park | A61F 7/007 |
| 2007/0025807 | A1 | 2/2007 | Liberatore | |
| 2009/0162132 | A1 | 6/2009 | Veasey et al. | |

FOREIGN PATENT DOCUMENTS

| | | | |
|---|---|---|---|
| CN | 101484039 | A | 7/2009 |
| FR | 1185116 | A | 7/1959 |
| JP | S60148258 | A | 8/1985 |
| JP | 2012012057 | A | 1/2012 |
| WO | 9640445 | A1 | 12/1996 |
| WO | 2004076308 | A1 | 9/2004 |
| WO | 2013041716 | A1 | 3/2013 |

OTHER PUBLICATIONS

"IPRP and Written Opinion for corresponding Application No. PCT/US2014/068473 dated Jun. 16, 2016".

* cited by examiner

DISPENSER FOR DISPENSING FLOWABLE MATERIAL

BACKGROUND OF THE INVENTION

Sunscreen lotion dispensers are well known in the prior art. Typically, sunscreen lotion is provided in a squeezable tube or container having a simple construction of a deformable reservoir and a discharge opening. To dispense sunscreen lotion, portions of the tube or the container are squeezed to deform against contents of the reservoir, resulting in lotion being displaced therefrom. There are several drawbacks of this design. The resulting rate or amount of dispensed product may not be well controlled with prior art designs. In addition, maximum depletion of the reservoir may be difficult because of inability to fully urge contained contents out of the reservoir. Users also may inefficiently focus pressure on a portion of the tube or container without maximally exhausting the reservoir. Sunscreen lotion is typically applied to the skin by the hands and digits. After the sunscreen lotion is applied, an unwanted residue of sunscreen lotion typically remains on the hands and digits.

SUMMARY OF THE INVENTION

In one aspect, a dispenser is provided herein for dispensing flowable material, such as sunscreen lotion, including a resiliently deformable body encompassing a closed volume to accommodate flowable material wherein deformation of the body from a natural state causes a reduction of volume of the closed volume. A discharge element is also provided having at least one discharge opening defined therein, and at least one valve for regulating the flow of the flowable material. A vent is formed to communicate atmosphere outside of the body with the closed volume. The vent allows for introduction of air into the closed volume to facilitate restoration of the body to the natural state after being deformed. The body is configured so that a threshold amount of deformation of the body causes sufficient reduction in volume of the closed volume so that flowable material is urged from the closed volume through the discharge opening via the at least one valve.

The closed volume of the body may serve as a reservoir to hold the flowable material. When the body is deformed, the flowable material in the reservoir is urged from the closed volume through the discharge opening via the at least one valve. Alternatively, a flexible pouch, formed to accommodate the flowable material, is disposed in the closed volume. The body is configured so that a threshold amount of deformation of the body causes sufficient reduction in volume of the closed volume to increase pressure of the closed volume acting on the flexible pouch sufficiently so that flowable material accommodated in the flexible pouch is urged therefrom through the discharge opening via the at least one valve. Advantageously, the dispenser of the subject invention allows for generated pressure to be applied to the flexible pouch to cause dispensing therefrom. This avoids deformation of a tube or bottle directly against a flowable material, such as with the prior art. The generation of pressure within the closed volume allows for a generally isobaric environment to be created which acts evenly about the flexible pouch, rather than certain portions thereof. This allows for a more even application of pressure acting against, and a more complete depletion of the flexible pouch.

In a further aspect, a dispenser is provided herein for dispensing flowable material, including: a body; a reservoir to accommodate flowable material; a spatula-shaped applicator having opposing faces joined by, and terminating at, a free edge; and, at least one discharge opening defined in one of the faces in proximity to the free edge, the at least one discharge opening being in communication with the reservoir.

As used herein, the term "flowable material" refers to any generally incompressible material which may be caused to flow under pressure, such as a lotion, ointment, cream, suspended product or slurry.

These and other features of the invention will be better understood through a study of the following detailed description and accompanying drawings.

DETAILED DESCRIPTION OF THE INVENTION

Figure 1:
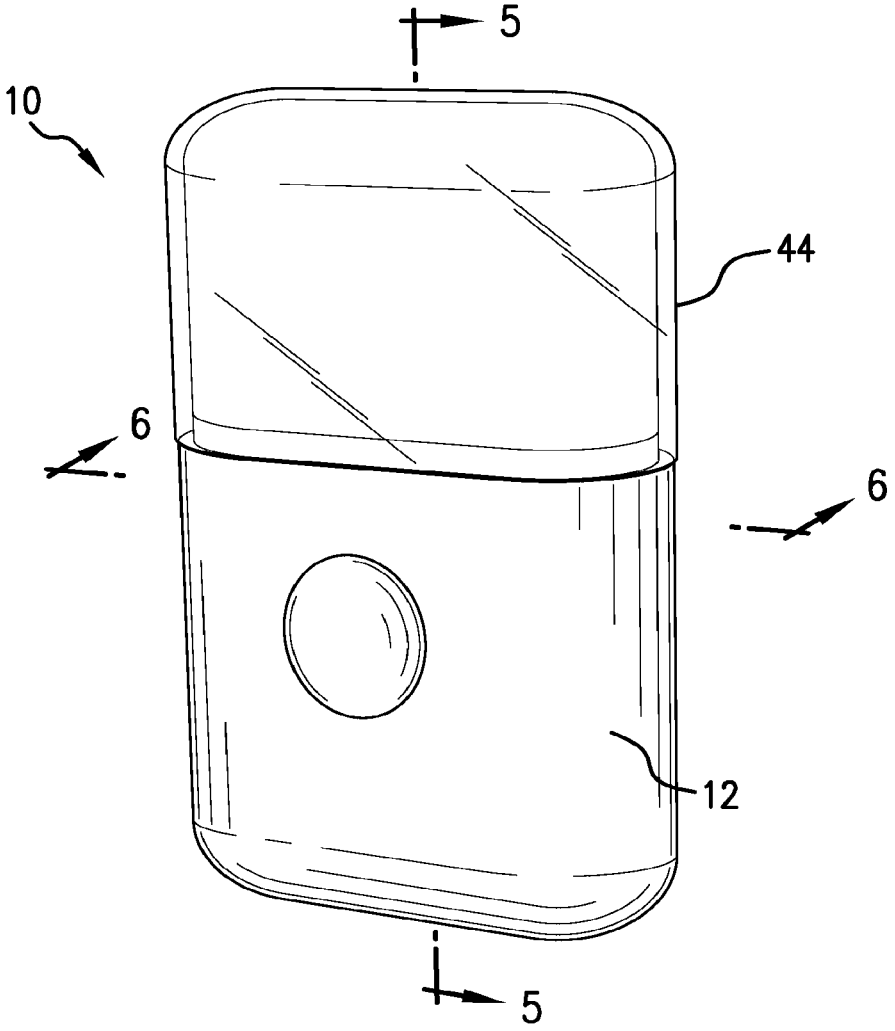
FIGS. 1-2 are perspective views of a dispenser formed in accordance with the subject invention.

With reference to the Figures, a dispenser 10 is shown useable for dispensing flowable material. As will be appreciated by those skilled in the art, the dispenser 10 may be used for various flowable materials, but is particularly well-suited for use with sunscreen lotion.

The dispenser 10 generally includes a resiliently deformable body 12 encompassing a closed volume 14, an optional flexible pouch 16 in the closed volume 14; a discharge element 18 having at least one discharge opening 20 defined therein; at least one valve 22 regulating flow to the discharge opening 20 from the closed volume 20 or the flexible pouch 16 as apropriate; and, a vent 24 formed to communicate atmosphere outside of the body 12 with the closed volume 14.

The body 12 may be of various configurations including being a unitary construction or a compilation of elements joined together. By way of non-limiting example, as shown in the Figures, the body 12 may include a cup-shaped piece having a base 26 and a side wall 28 extending upwardly therefrom. Portions of the body 12, such as portions of the side wall 28, are formed to be resiliently deformable from an at-rest natural state. The at-rest natural state is an unstressed condition. The body 12 may be formed to be resiliently deformable by being formed with a constituent material having sufficient inherent memory to return to a natural state upon being released from a deformed state. For example, the body 12 may be formed from one or more thermoplastic materials, elastomeric materials, or combinations thereof, to allow for such resilient deformation.

Figure 12:
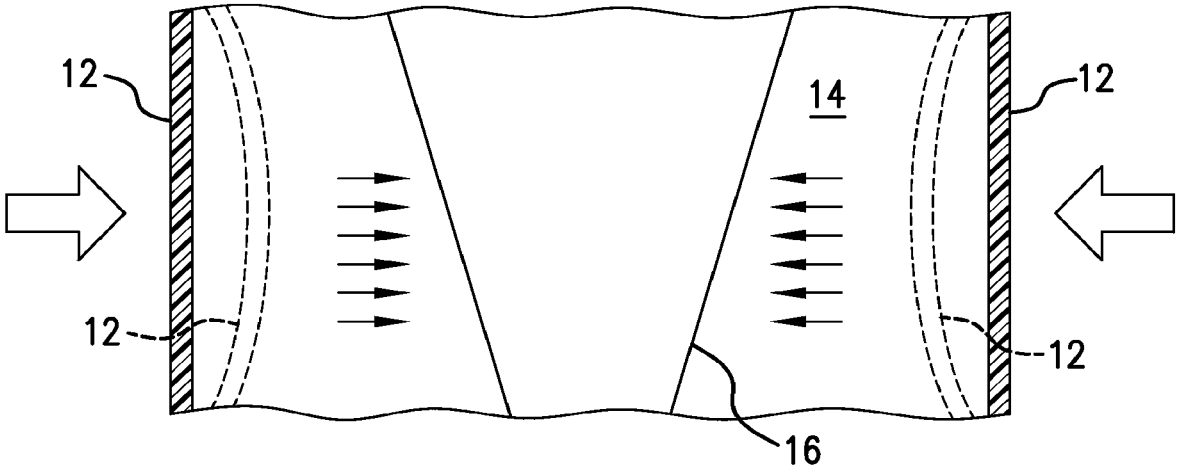
FIG. 12 schematically shows deformation of the body with increased pressure of the closed volume in accordance with the subject invention.
Figure 13:
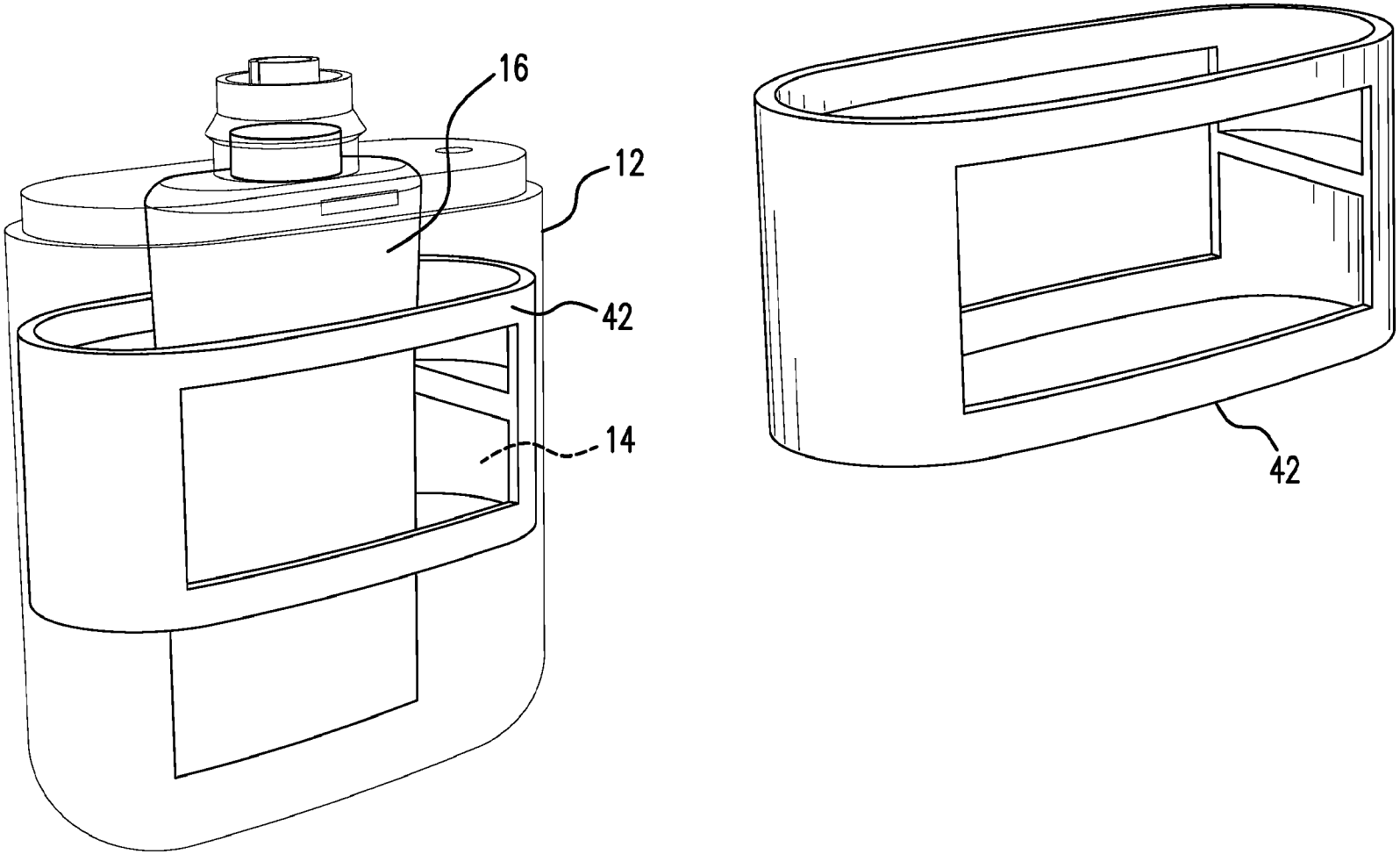
FIG. 13 shows a frame useable with the subject invention.

As shown in FIG. 12, with deformation of the body 12, the volume of the closed volume 14 is caused to be decreased. This, in turn, causes the pressure within the closed volume 14 to increase (as represented by the small arrows within the closed volume 14). Deformation of the body 12 may be caused by various techniques, including manual application pressure of the body 12. Release of such pressure allows for the body 12 to return generally to its natural state.

The closed volume 14 must be sufficiently closed so as to allow for pressure increase therein with a reduction in volume. With the closed volume 14 being closed, restoration of the body 12 to the natural state may not be properly achieved without venting of the closed volume 14. The vent 24 allows for introduction of air into the closed volume 14 to facilitate restoration of the body 12 to the natural state after being deformed. The vent 24 may be a one-way vent, configured to permit flow of air into the closed volume 14 and to restrict reverse flow therefrom. Any known configuration may be utilized for the vent 24 including a one-way vent, for example, a duckbill-type valve. The vent 24 may in the alternative be open (i.e., not one-way), e.g., defined by one or more interfaces between components of the dispenser 10 through which air may pass into the closed volume 14.

Figure 4B:
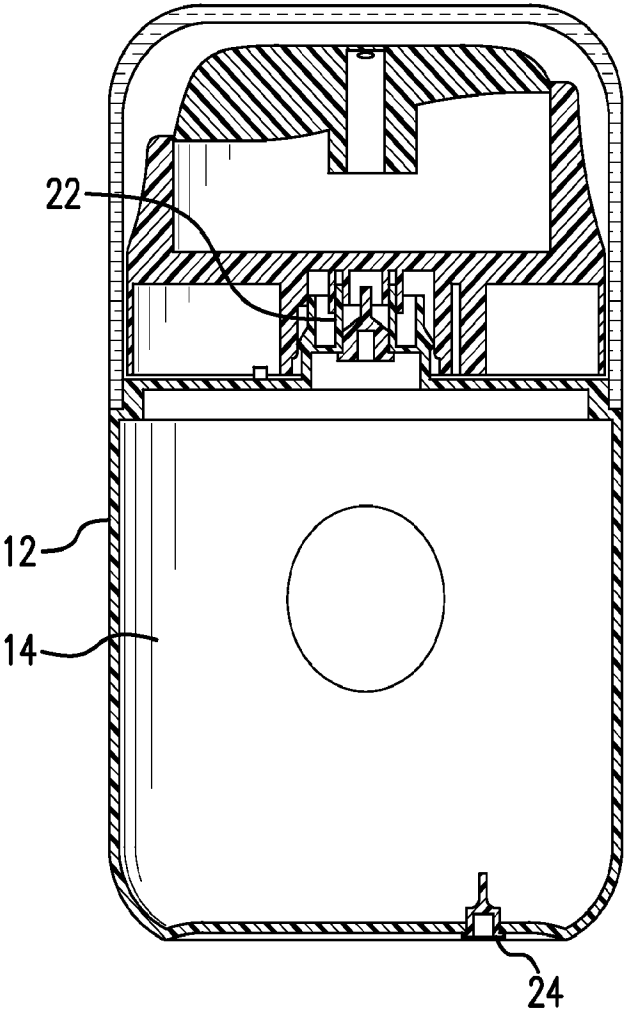
FIGS. 4A-4B show possible vent locations useable with the subject invention.
Figure 4A:
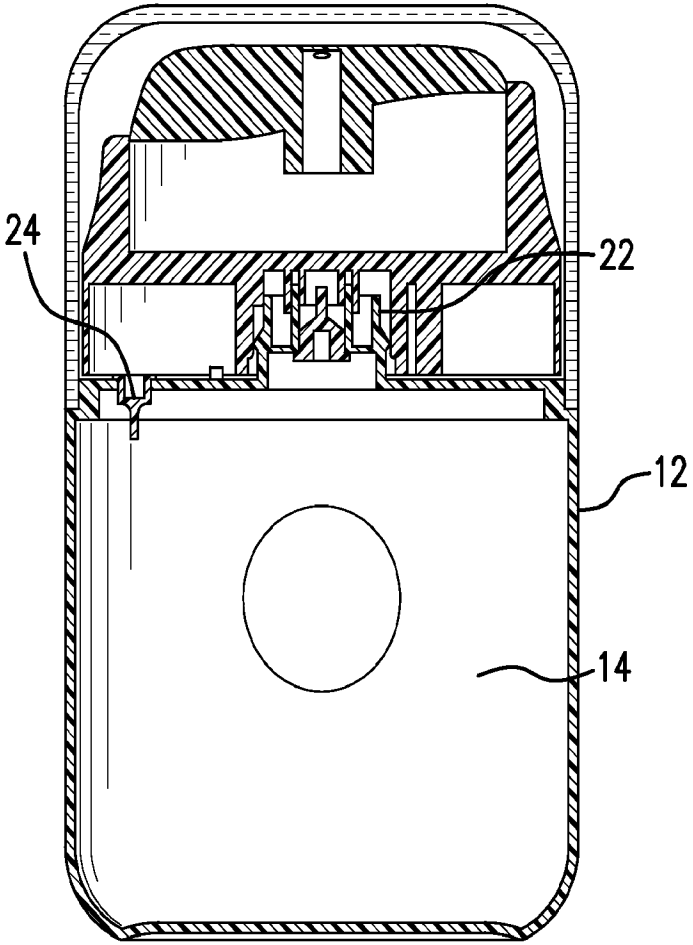

To ease manufacturing and assembly, a portion of the body 12 may be formed as a removable cap 30, as shown in the Figures. This allows for a more efficient placement of the flowable material into the closed volume 14, directly or with the flexible pouch 16. The cap 30 is secured to other portions of the body 12, such as the side wall 28, using any known technique, including, but not limited to, mechanical interactions (e.g., interlocking features such as snap engagement detents and grooves, threads, cooperating bayonet locking elements), adhesion, fusion, and so forth. The vent 24 may be located on the cap 30 (FIG. 4A) and/or defined between the cap 30 and other portions of the body 12. Alternatively, or additionally, the vent 24 may be located on a different part of the body 12, such as the base 26 (FIG. 4B).

In one embodiment, the flexible pouch 16 may be provided to accommodate a sufficient quantity of the flowable material and may be formed of any flexible film or sheet material which is sufficiently flexible to be responsive to pressure applied thereto as described below. For example, the flexible pouch 16 may be formed of a thermoplastic material, e.g., by blow molding. In a preferred embodiment, the flexible pouch 16 will not be properly vented; this will allow the flexible pouch 16 to contract in response to flowable material being discharged therefrom.

Alternatively, the closed volume 14 of the body 12 may act as a reservoir for the flowable material. With this arrangement, the flexible pouch 16 is not required. Deformation of the body 12 may be used to urge the flowable material from the closed volume 14.

The flexible pouch 16 includes an opening 32 secured to a portion of the body 12, such as the cap 30, through which flowable material may be urged. A discharge passage 34 is positioned in the dispenser 10 to receive flowable material discharged from the opening 32 or the closed volume 14. By utilizing the cap 30, the flexible pouch 16 may be placed into the closed volume 14 during the step of securing the cap 30 to other portions of the body 12. Alternatively, the flowable material may be disposed into the closed volume 14 with the cap 30 thereafter being secured to other portions of the body 12.

The discharge passage 34 is defined to pass through a portion of the body 12, such as the cap 30. The discharge passage 34 may be defined by one or more secondary members, such as a portion of the body 12 (e.g., the cap 30), a portion of the discharge element 18 and/or an extension 35. The extension 35 may extend between portions of the body 12 and the discharge element 18.

Figure 14:
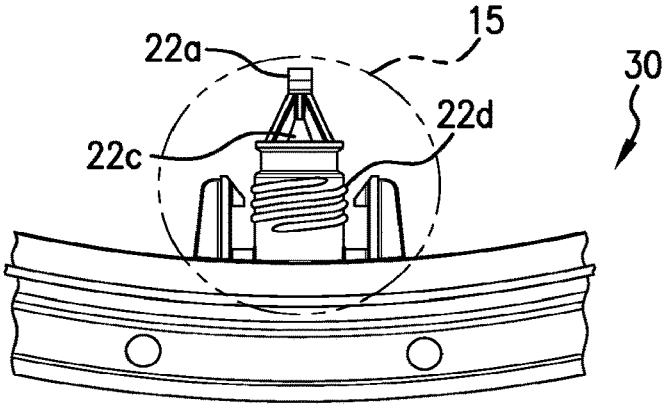
FIGS. 14-16 show a cap useable with the subject invention.
Figure 15:
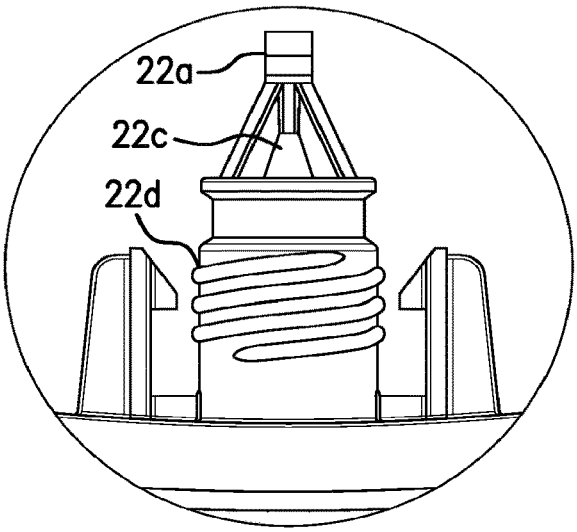
Figure 16:
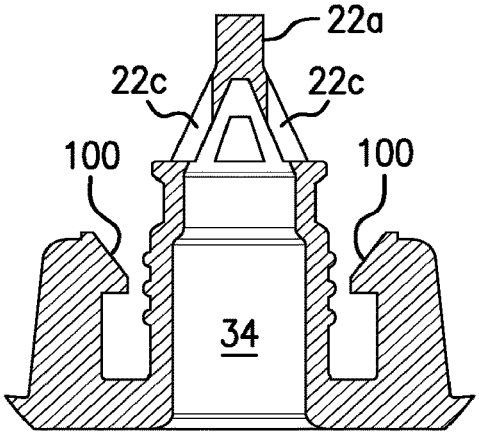
Figure 17:
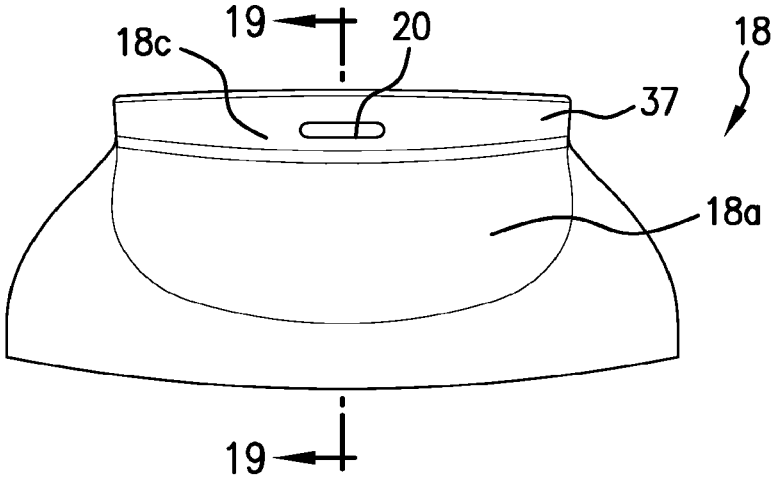
FIGS. 17-19 show a discharge element useable with the subject invention.
Figure 18:
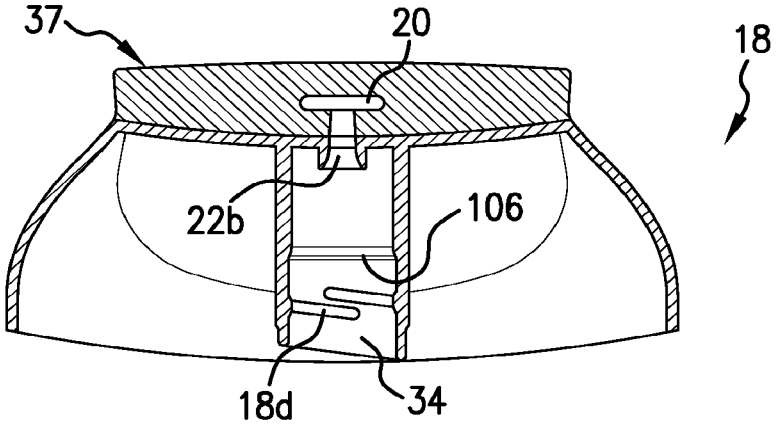
Figure 19:
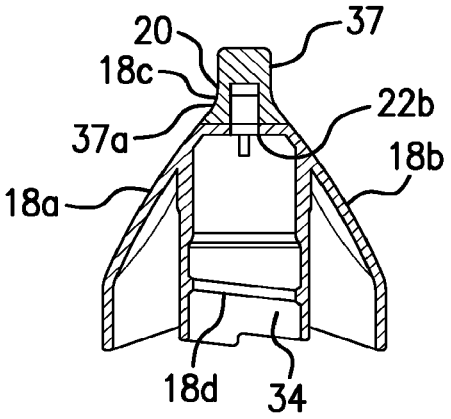
Figure 20:
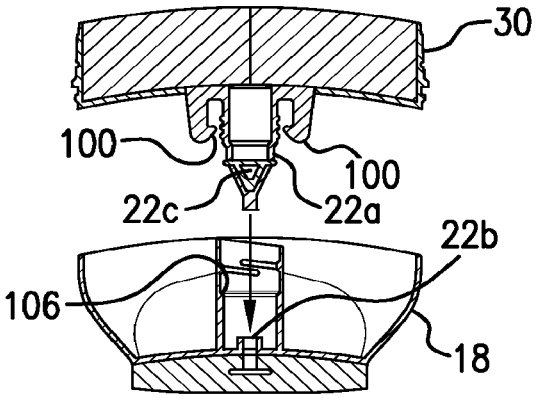
FIGS. 20-21 show a valve arrangement useable with the subject invention.

The valve 22 is situated to regulate flow of flowable material from the pouch 16 or the closed volume 14. In one configuration, the valve 22 may be a one-way valve which permits flow from the pouch 16 or the closed volume 14 but restricts flow in a reverse direction. Alternatively, the valve 22 may be an adjustable valve which can be selectively adjustable between open and closed states to selectively communicate the opening 32 or the closed volume 14 with the discharge opening 20. As an adjustable valve, the valve 22 may be kept in the closed state when not in use to limit ingress of air and other possible contaminants into the flowable material. For example, the valve 22 may be a ball type valve which is rotatable between open and closed states. The valve 22 may be a plunger type valve with a rotatable plunger 22*a* that is selectively seated in a valve seat 22*b* to seal the opening 32 or the closed volume 14 from the discharge opening 20. As shown in FIGS. 14-16, the plunger 22*a* may be formed on the cap 30 with one or more discharge apertures 22*c* being formed through the plunger 22*a* to permit flow therethrough of the flowable material. As shown in FIGS. 17-19, the valve seat 22*b* may be formed on the discharge element 18. With the plunger 22*a* seated in the valve seat 22*b* (FIG. 21), the discharge opening 20 is sealed from, and out of communication with, the opening 32 or the closed volume 14. Through relative movement between the discharge element 18 and the cap 30 (e.g., relative rotation), the plunger 22*a* may be separated from the valve seat 22*b* so as to permit flow of the flowable material to the discharge opening 20. As will be appreciated by those skilled in the art, the positioning of the plunger 22*a* and the valve seat 22*b* on the cap 30 and the discharge element 18 may be reversed. In addition, more than one valve may be used, e.g., two valves arranged in series; the valves may be of different types (e.g., one-way valve and adjustable valve) or of the same type. Preferably, the valve(s) 22 is/are located on a portion of the body 12, such as the cap 30.

Figure 5:
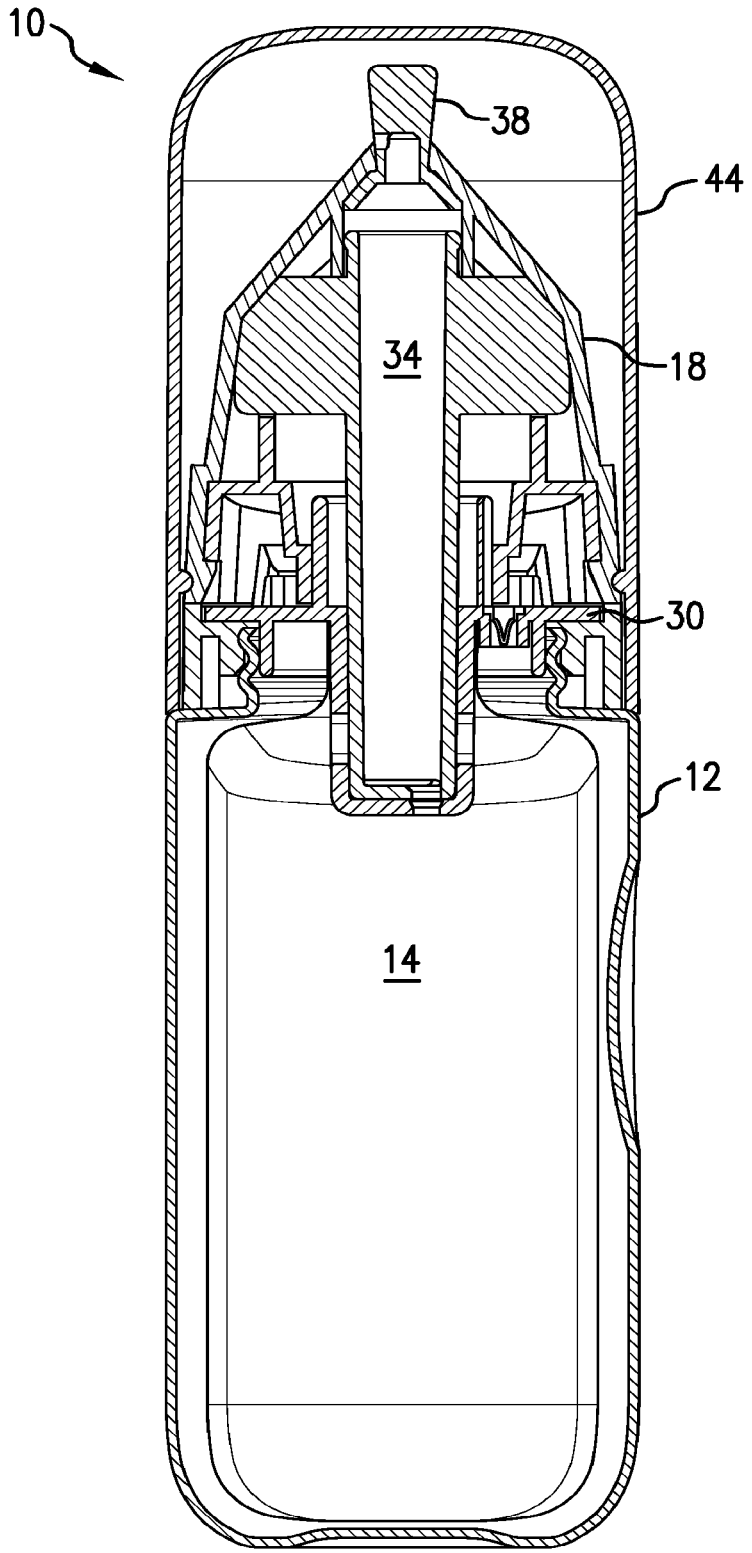
FIG. 5 is a cross-sectional view taken along line 5-5 of FIG. 1 (without a pouch being shown)
Figure 6:
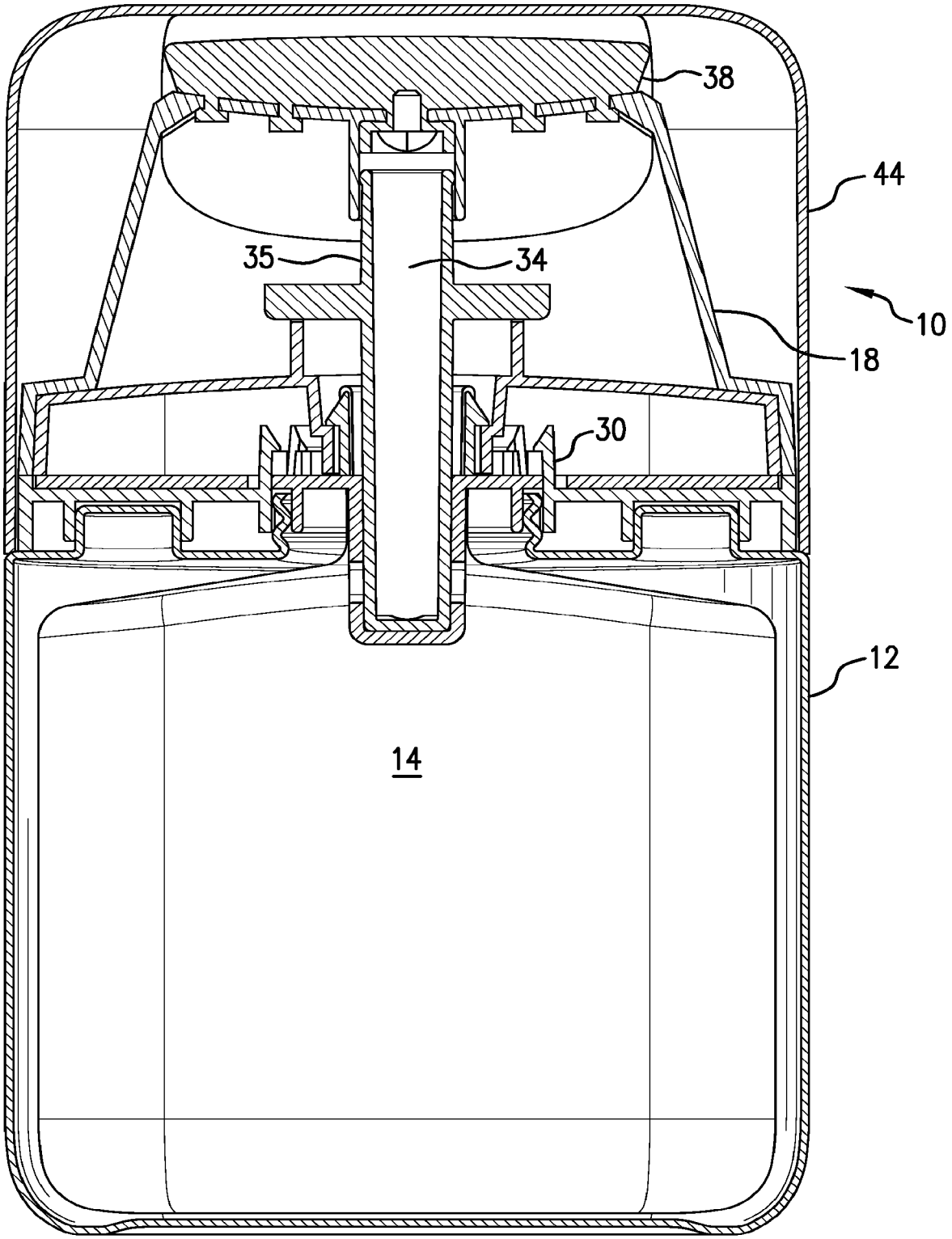
FIG. 6 is a cross-sectional view taken along line 6-6 of FIG. 1 (without a pouch being shown)
Figure 7:
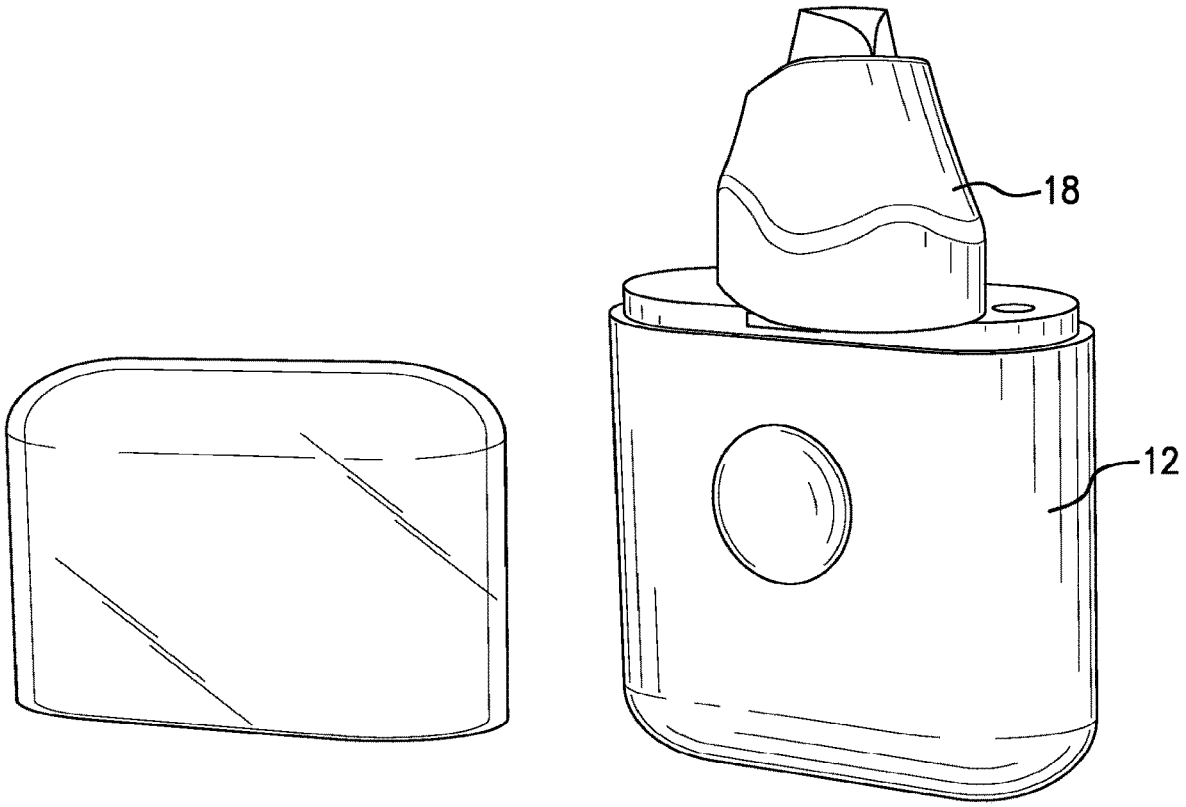
FIGS. 7-10 show a possible process of preparing a dispenser for use in accordance with the subject invention.
Figure 8:
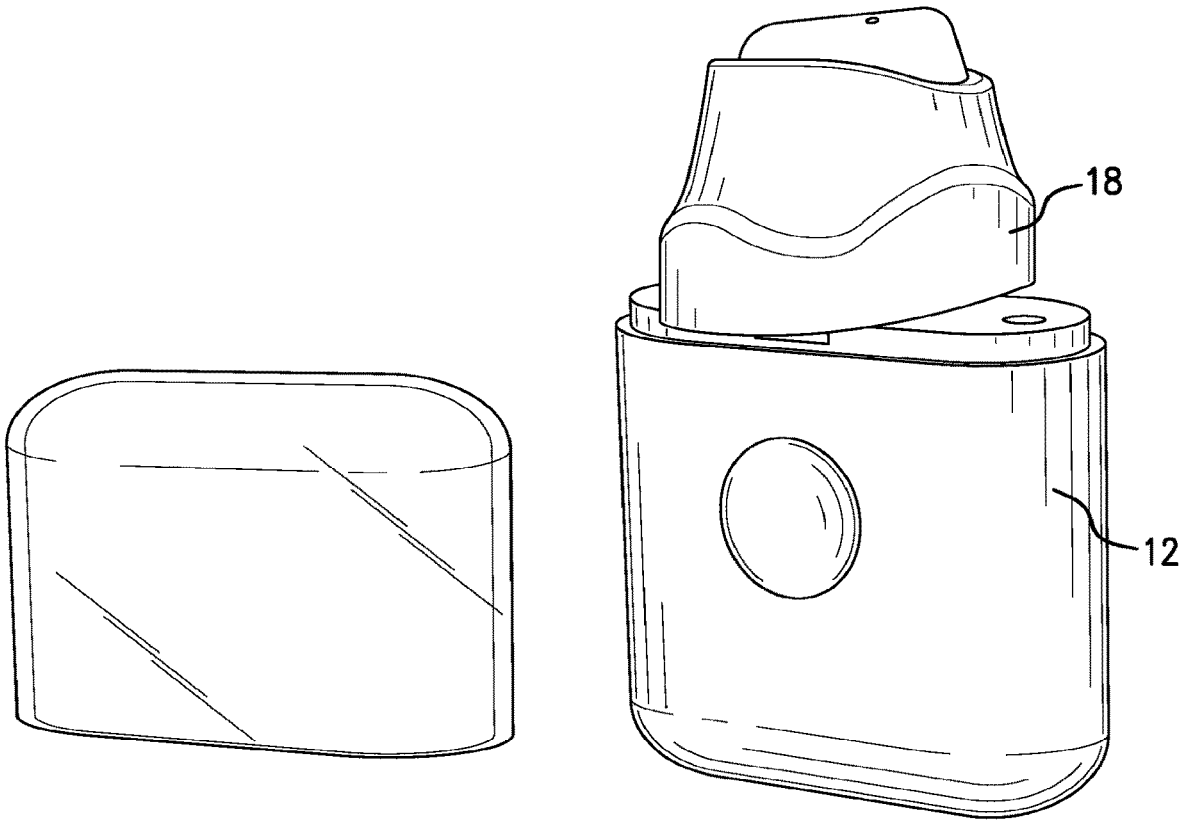
Figure 9:
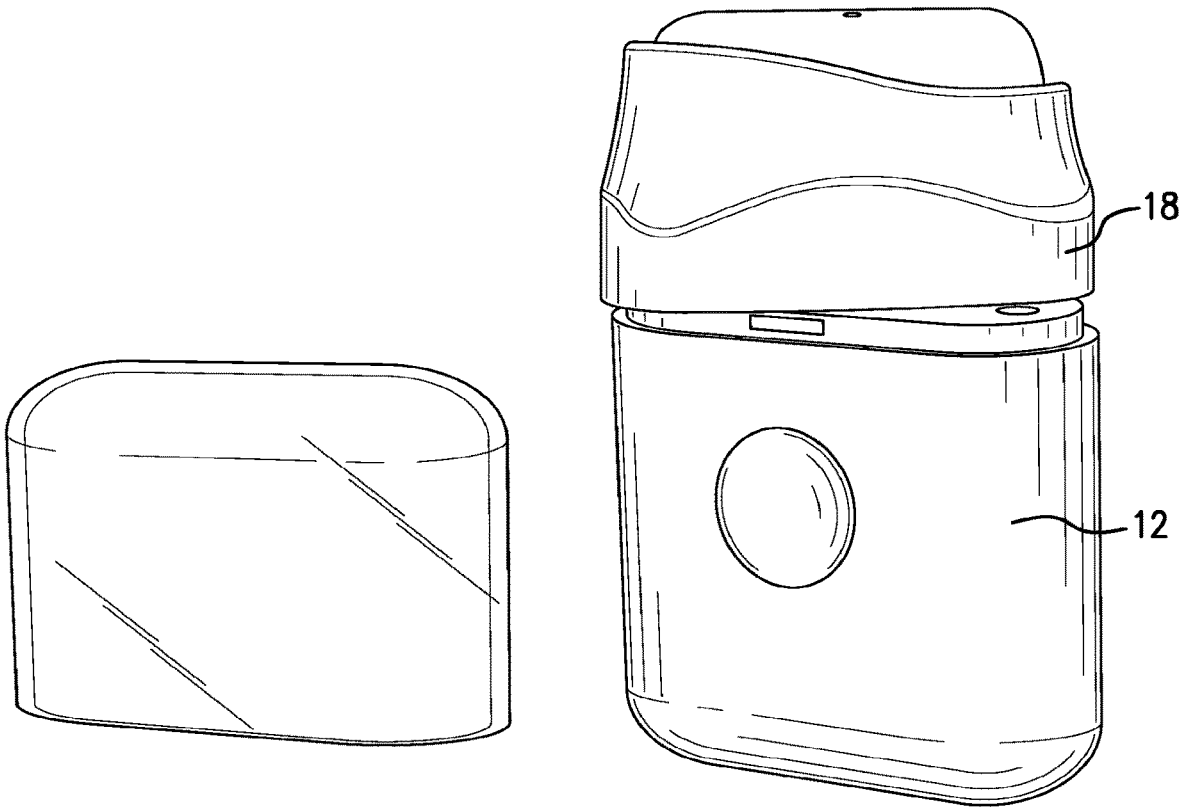
Figure 10:
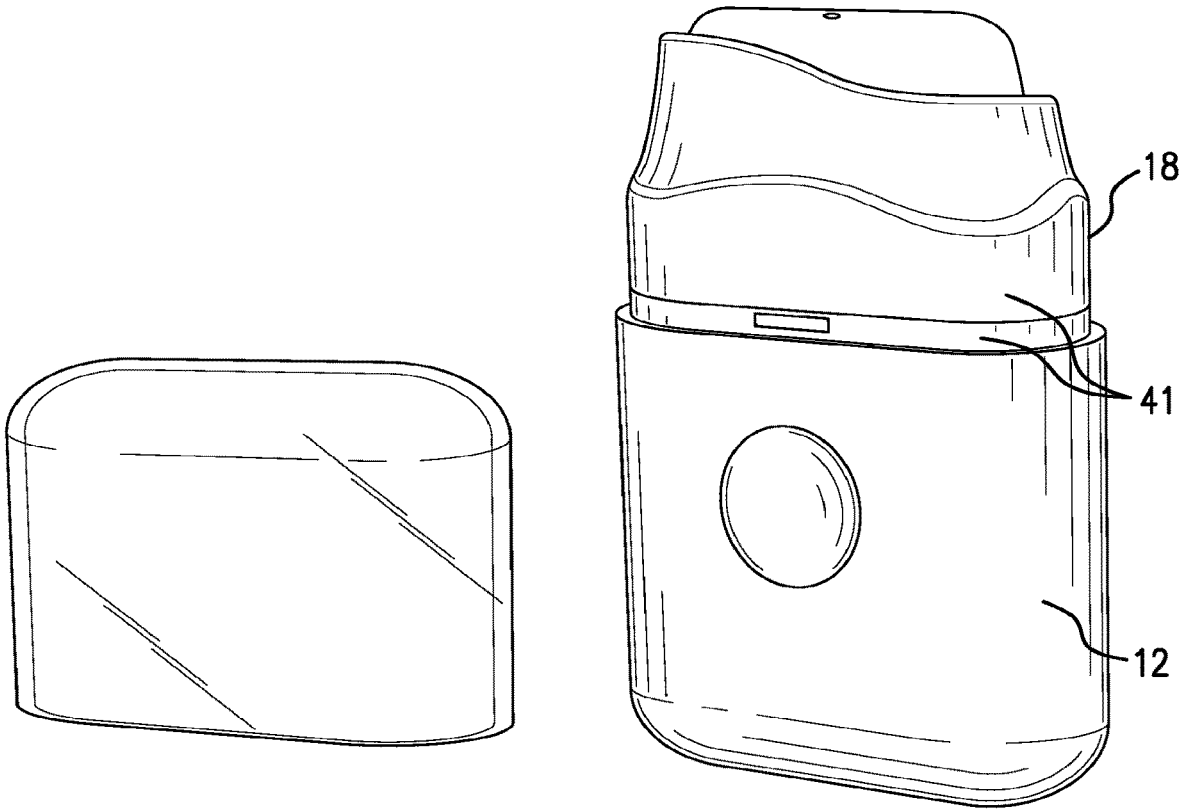

The discharge element 18 is situated to have the discharge opening 20 in communication with the discharge passage 34 and may be formed of various configurations. By way of non-limiting example, and as shown in the Figures, the discharge element 18 may include an applicator 37. The applicator 37 may be spatula-shaped with opposing faces 36 joined by, and terminating at, free edge 38 and with the discharge opening 20 being located in proximity to the free edge 38. For example, the free edge 38 may be utilized to spread sunscreen lotion on the skin of a user. Preferably, the applicator 37 is formed of a compliant material, such as silicon and/or thermoplastic elastomer (TPE), to provide comfort to a user for such application. In addition, or alternatively, the applicator 37 may be formed as a cantilevered rib of material (FIG. 5) which inherently has compliance. A plurality of discharge openings 20 may be likewise utilized, for example arranged in a particular pattern for even distribution of flowable material.

As shown in FIGS. 5 and 17-19, the discharge element 18 may define side surfaces 18*a* and 18*b* which extend from base 37*a* of the applicator 37. A pocket 18*c*, located on the same side as at least one of the discharge opening(s) 20, may be defined where the flowable material may collect during application. Thus, the flowable material may be caused to be discharged from the discharge opening(s) 20 with the material collecting in the pocket 18*c* as being applied to a user's skin. The pocket 18*c* may be defined by an angular change in one or more surfaces (e.g., base 37*a* being flared) and/or an interface between two or more non-coplanar surfaces (e.g., an interface between the side surface 18*a* and the applicator 37).

The discharge element 18 may be secured to the valve 22 to cause selective adjustment thereof where the valve 22 is an adjustable valve. For example, rotation of the discharge element 18 may be utilized to selectively adjust the valve 22 between open and closed states. Cooperating threads 22*d* and 18*d* on the cap 30 and the discharge element 18, respectively, may be provided to allow for selective rotation therebetween.

Figure 2:
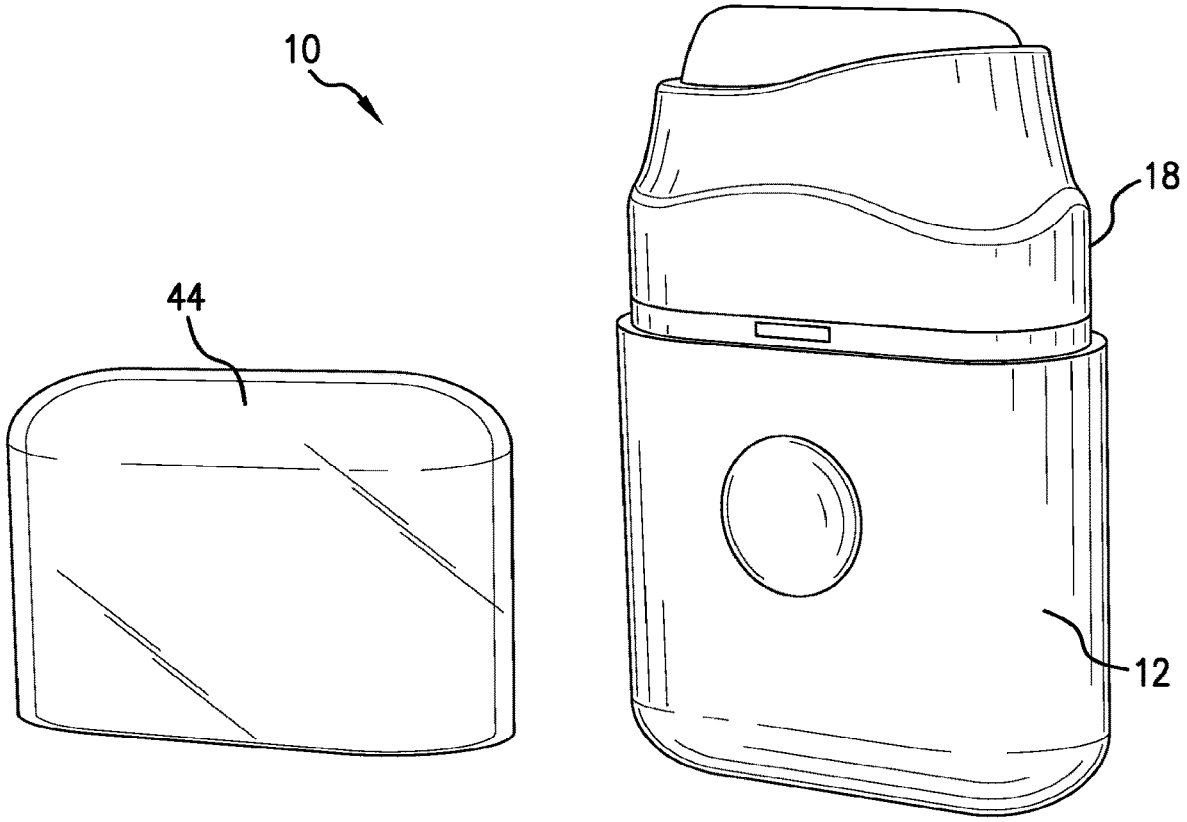
Figure 3:
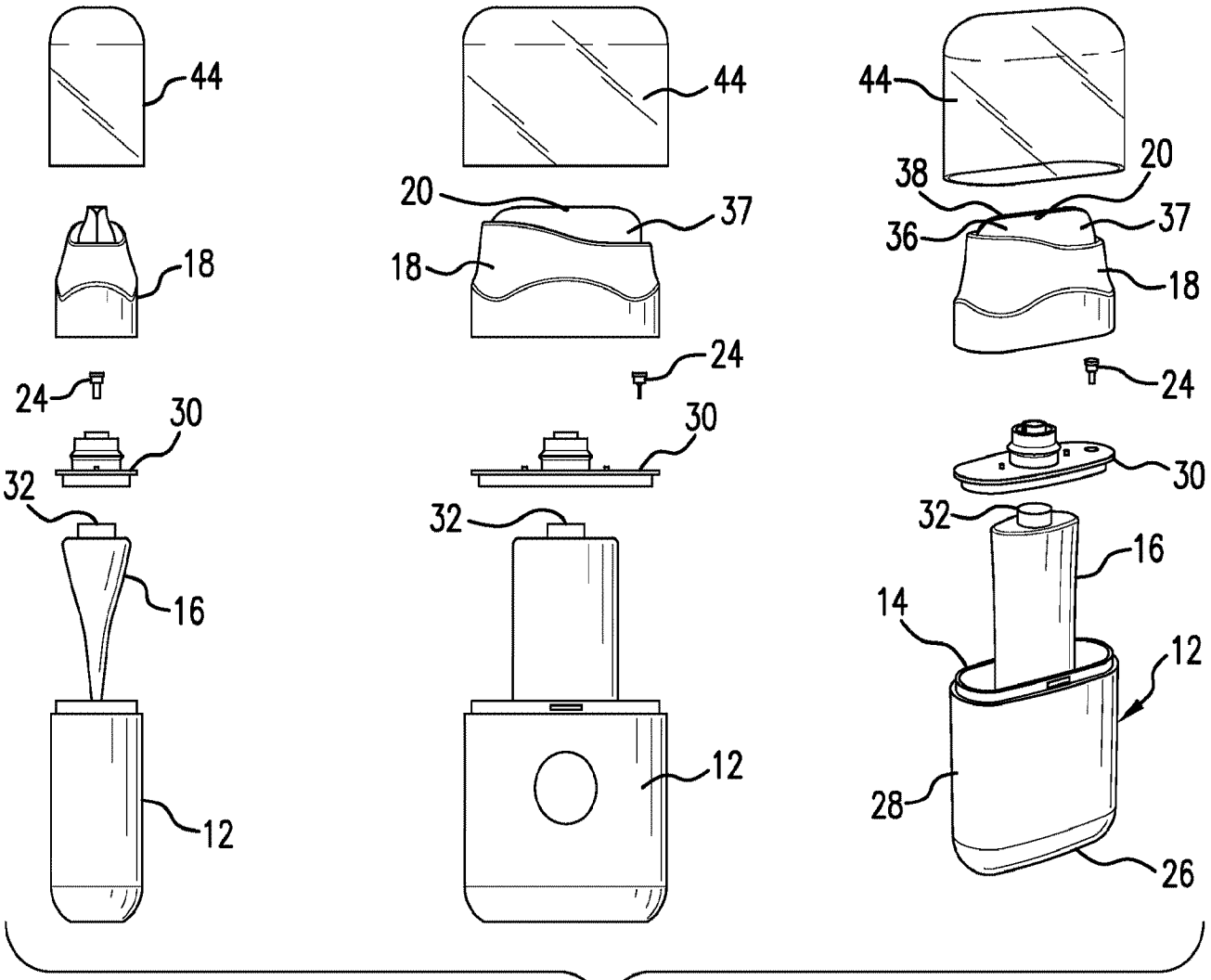
FIG. 3 are exploded views of a dispenser formed in accordance with the subject invention.
Figure 22:
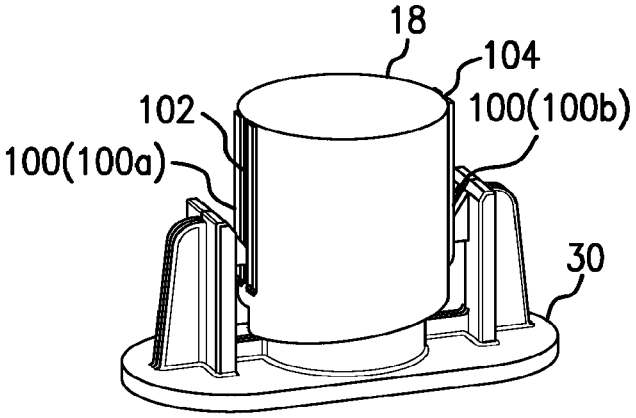
FIGS. 22-23 show a releasable retaining arrangement useable with the subject invention; and, FIG. 24 shows an overcap useable with the subject invention.
Figure 23:
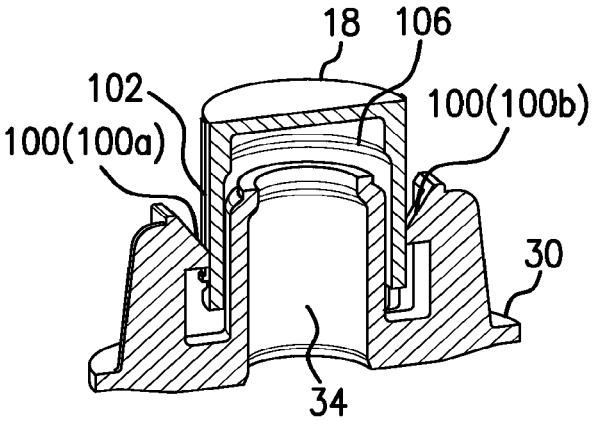

With the dispenser 10 being assembled, a pouch 16 may be loaded with flowable material and located inside the closed volume 14 or the flowable material will be disposed directly into the closed volume 14 without the pouch 16. For use, the dispenser 10 is initially prepared as needed. For example, the valve 22 may be adjusted from a closed state to an open state (e.g., by rotating the discharge element 18), as shown in FIGS. 7-10. It is noted that the dispenser 10 may be considered to be in an "off" state with the valve 22 closed, such as the state shown in FIGS. 1 and 2. The dispenser 10 may be adjusted to an "on" state, such as by rotating the discharge 180 degrees relative to the body 12. Releasable retaining arrangements may be provided to releasably retain the discharge element 18 in the "off" and/or "on" states, such as releasable detents. For example, as shown in FIGS. 22-23, at least one releasable detent 100 may be provided on the cap 30 formed to nest in a cooperating recess 102 formed on a portion of the discharge element 18. The point of engagement between the detent 100 and the recess 102 may be used to define the "on" or "off" state of the dispenser 10. As shown in FIGS. 22-23, more than one detent 100 may be provided, with each detent, respectively, defining the "on" and the "off" states. Thus, detent 100*a* may define the "off" state, while rotation of the recess 102 into engagement with detent 100*b* causes the dispenser 10 to be put into the "on" state. A secondary recess 104 may be used to engage the detent 100 not engaged by the recess 102 to provide additional retentive engagement. The detents 100 are formed to be resiliently displaceable to allow for repeated release from, and engagement with, the recess 102. As will be appreciated by those skilled in the art, the positioning of the detents 100 on the cap 30 and the recesses 102 and 104 on the discharge element 18 may be reversed in any combination. One or more stops 106 may be provided in addition to or alternatively from the detent 100/recess 102 arrangement. The stop 106 may be a protrusion, e.g., ring-shaped, on the discharge element 18 which limits travel of the cap 30 relative thereto.

In addition, indicia 41 may be provided to provide indication that the dispenser 10 is in the "off" and/or "on" state. For example, the indicia 41 may be located on both the body 12 and the dispensing element 18 and configured to provide a visual indication of the present state when aligned.

Figure 11:
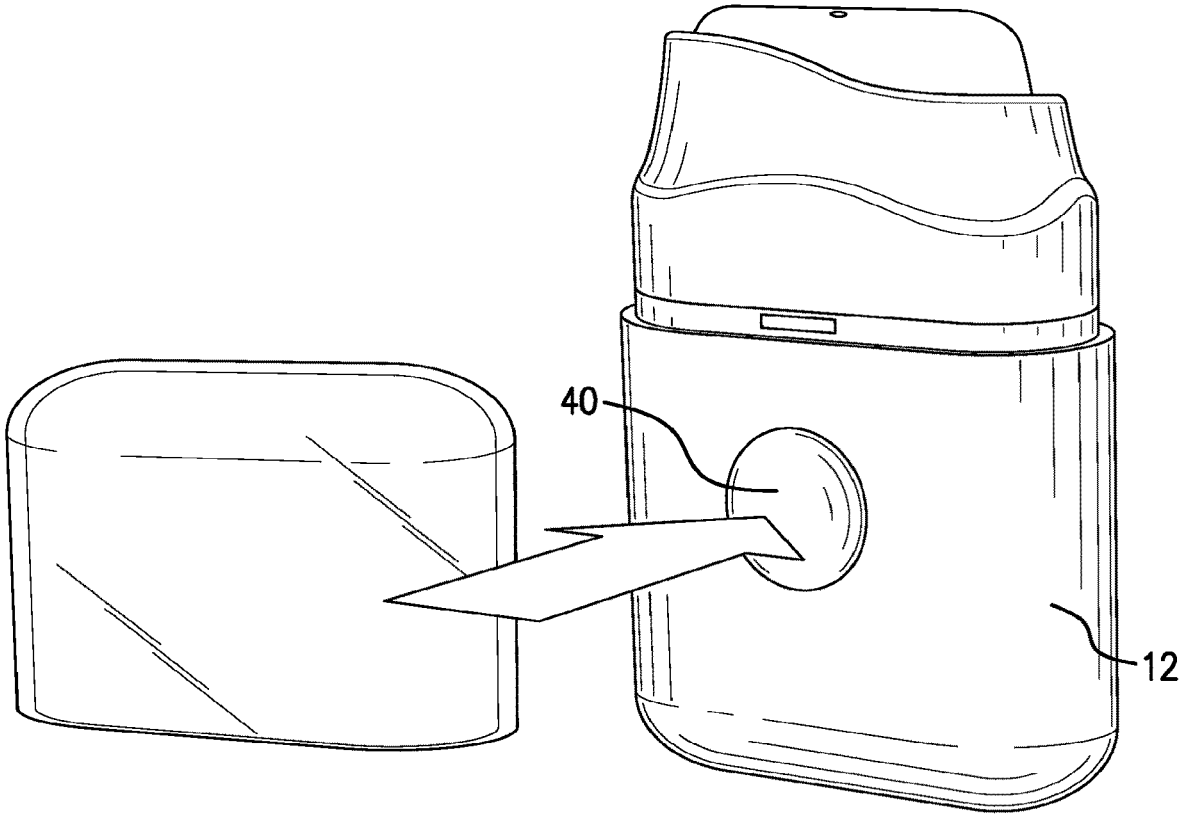
FIG. 11 shows a possible mode of deformation useable with the subject invention.

With reference to FIG. 11, to administer product, force, e.g. by manually squeezing a portion of the body 12 (e.g., the side wall 28), is applied to the body 12 to cause deformation thereof. Surface configurations 40, such as dimples and/or other indicia, may be provided on the body 12 to define target area(s) for force application. The body 12 is configured so that a threshold amount of deformation of the body 12 results in a target reduction in volume of the closed volume 14. The reduction in volume of the closed volume 14 creates a pressure increase (FIG. 12) sufficiently to cause flowable material to be urged from the pouch 16 or the closed volume 14, as appropriate, and through the discharge opening 20 via the valve 22. The pouch 16, if used, contracts correspondingly as flowable material is discharged therefrom.

With using the pouch 16, it is preferred that deformed portions of the body 12 at the threshold amount of deformation be spaced from, so as to be out of contiguous contact with, the flexible pouch 16. Thus, direct contact may be avoided. It is preferred to have the pressure increase in the closed volume 14 create a generally isobaric environment which acts evenly about the pouch 16 with no portions of the body 12 directly pressing against the pouch 16 during a dispensing procedure.

Once a dose of flowable material has been administered, force is removed from the body 12, e.g., releasing the squeezing force. With the force released, the body 12 will seek to restore to its natural state. Under such force of restoration, the volume of the closed volume 14 is caused to increase with venting via the vent 24. With restoration to the natural state, the dosing process can be repeated as desired. Once dosing is complete, the valve 22 may be adjusted to a closed state, as needed.

As an additional feature, a frame 42 may be provided which is located in the closed volume 14 about at least portions of the flexible pouch 16. The frame 42 may be configured to restrict the amount of deformation of the body 12. For example, the frame 42 may be positioned to limit the extent of inward deflection of the side wall 28. Also, an overcap 44 may be provided to releasably mount to the body 12. Preferably, the overcap 44 encompasses the discharge opening 20, and possibly the applicator 37, when mounted to the body 12. The overcap 44 may be partially or fully transparent.

Figure 21:
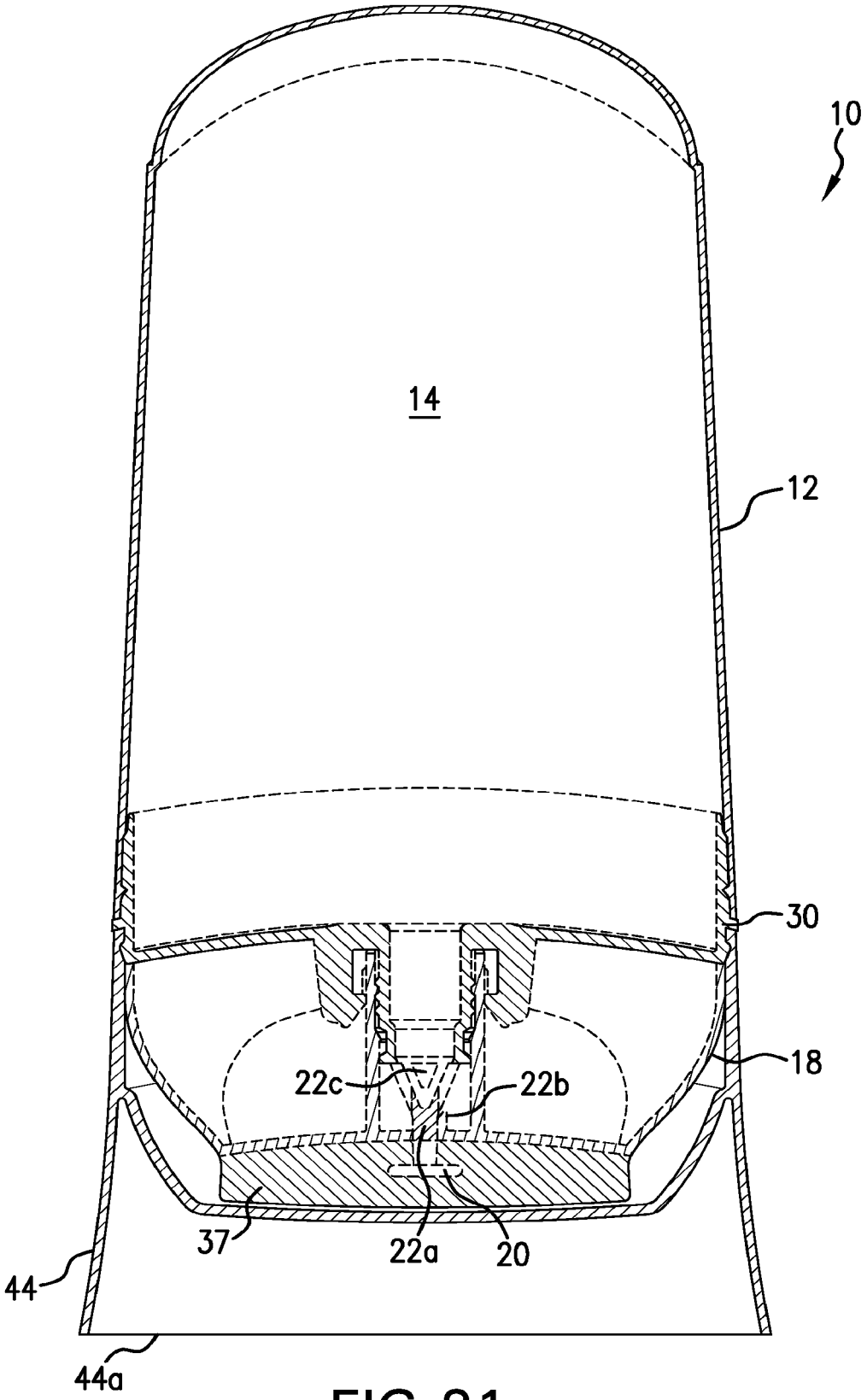
Figure 24:
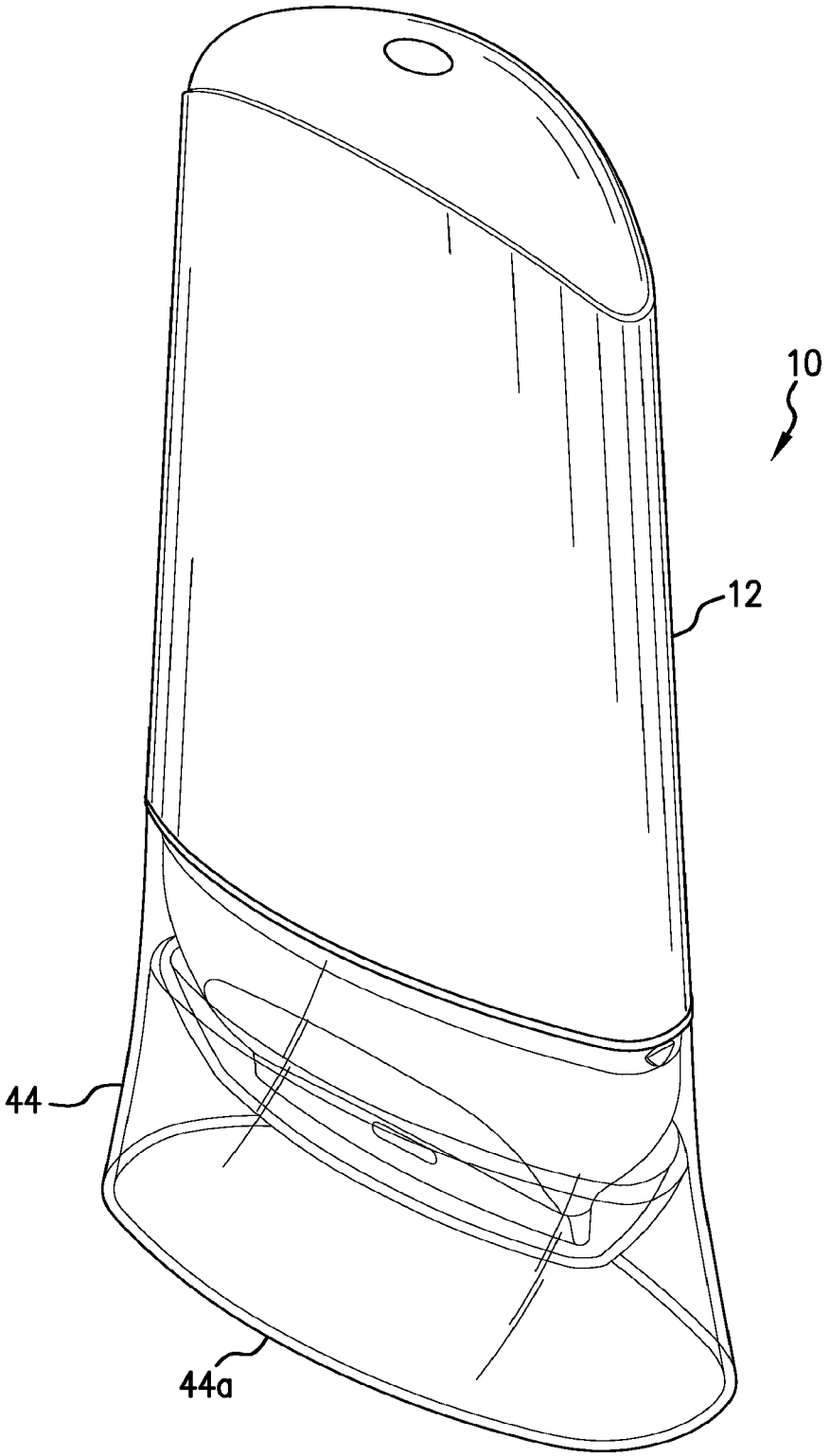

As shown in FIGS. 21 and 24, the overcap 44 may be provided with a resting surface 44*a*. The dispenser 10 may be caused to be inverted and rest upon the resting surface 44*a* with the overcap 44 mounted thereto, particularly where the flowable material is located in the closed volume 14 without the pouch 16. This allows for the flowable material to be urged, under force of gravity, towards the discharge passage 34 in anticipation of administration (against the valve 22 if closed). With this arrangement, the closed volume 14 is preferably vented in the inverted state.

Further, the discharge element 18 may be configured to block the vent 24 to restrict venting with the dispenser 10 being in an "off" state. This further inhibits discharge from the pouch 16 or the closed volume 14 if the body 12 is inadvertently deformed (e.g., by accidental application of force) in addition to the valve 22 being in a closed state.

What is claimed is:

1. A dispenser for dispensing flowable material, the dispenser comprising:

a resiliently deformable body encompassing a closed volume to accommodate flowable material, wherein deformation of said body from a natural state causes a reduction of volume of said closed volume;

a discharge element having at least one discharge opening defined therein;

at least one valve regulating the flow of the flowable material through said at least one discharge opening; and, a vent formed to communicate atmosphere outside of said body with said closed volume, wherein said vent allows for introduction of air into said closed volume to facilitate restoration of said body to said natural state after being deformed, wherein said discharge element includes a spatula-shaped applicator having opposing faces joined by, and terminating at, a free edge;

wherein the discharge element is secured to the at least one valve; and wherein, said body being configured so that a threshold amount of deformation of said body causes sufficient reduction of volume of said closed volume so that the flowable material is urged therefrom through said at least one discharge opening via said at least one valve.

2. The dispenser as in claim 1, wherein the closed volume acts as a reservoir to accommodate the flow able material.

3. The dispenser as in claim 1, wherein a flexible pouch, formed to accommodate flowable material, is disposed in said closed volume, wherein deformation of said body causes sufficient reduction of volume to increase pressure of said closed volume acting on said flexible pouch sufficiently so that flowable material accommodated in said flexible pouch is urged therefrom through said as least one discharge opening via said at least one valve.

4. The dispenser as in claim 1, wherein said at least one valve is a one-way valve, configured to only permit flow from said flexible pouch or closed volume.

5. The dispenser as in claim 1, wherein said at least one valve is adjustable from a closed state to an open state.

6. The dispenser as in claim 5, wherein said at least one valve is a one-way valve configured to only permit flow from said flexible pouch.

7. The dispenser as in claim 3, further comprising a frame disposed within said closed volume about at least portions of said flexible pouch, said frame being configured to restrict the amount of deformation of said body.

8. The dispenser as in claim 3, wherein deformed portions of said body at said threshold amount of deformation are spaced from, so as to be out of contiguous contact with, said flexible pouch.

9. The dispenser as in claim 1, wherein said at least discharge opening is defined in one of said faces in proximity to said free edge.

10. The dispenser as in claim 1, wherein said vent is a one-way vent.

11. The dispenser of claim 1, wherein said dispensing flowable material is a sunscreen lotion.

12. The dispenser of claim 1, wherein said applicator is formed of a material that provides comfort to a user.

13. The dispenser of claim 12, wherein said applicator is formed of silicon or thermoplastic elastomer.

14. A method for applying a flowable material to a user, comprising applying force to the body of the dispenser of claim 1, to urged said flowable material through the discharge opening, and using the free edge of the applicator to apply said flowable material to the user.

* * * * *